US007326089B2

(12) United States Patent
Hashim

(10) Patent No.: US 7,326,089 B2
(45) **Date of Patent: *Feb. 5, 2008**

(54) COMMUNICATIONS JACK WITH PRINTED WIRING BOARD HAVING SELF-COUPLING CONDUCTORS

(75) Inventor: Amid Hashim, Plano, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 146 days.

This patent is subject to a terminal disclaimer.

(21) Appl. No.: 11/051,285

(22) Filed: Feb. 4, 2005

(65) Prior Publication Data

US 2006/0148325 A1 Jul. 6, 2006

Related U.S. Application Data

(60) Provisional application No. 60/636,590, filed on Dec. 16, 2004.

(51) Int. Cl.
*H01R 24/00* (2006.01)

(52) U.S. Cl. ..... 439/676; 439/941

(58) Field of Classification Search ..... 439/676, 439/941

See application file for complete search history.

(56) References Cited

U.S. PATENT DOCUMENTS 5,186,647 A 2/1993 Denkmann et al.
5,299,956 A 4/1994 Brownell et al.
5,310,363 A 5/1994 Brownell et al.
5,326,284 A 7/1994 Bohbot et al.
5,328,390 A 7/1994 Johnston et al.
5,362,257 A 11/1994 Neal et al.
5,397,862 A 3/1995 Bockelman et al.
5,414,393 A 5/1995 Rose et al.
5,432,484 A 7/1995 Klas et al.
5,459,643 A * 10/1995 Siemon et al. ..... 361/785

(Continued)

FOREIGN PATENT DOCUMENTS

EP 0 525 703 B1 2/1993

(Continued)

OTHER PUBLICATIONS

U.S. Appl. No. 10/845,104, filed May 14, 2004, Hashim.

(Continued)

*Primary Examiner*—Tho D. Ta
(74) *Attorney, Agent, or Firm*—Myers Bigel Sibley & Sajovec

(57) ABSTRACT

A communications jack includes: a jack frame having a plug aperture; a plurality of contact wires, the contact wires having free ends that extend into the plug aperture, the free ends of the contact wires being arranged serially in side-by-side relationship; a plurality of insulation displacement connectors; a dielectric mounting substrate, the mounting substrate including a plurality of mounting locations for contact wires and a plurality of mounting locations for insulation displacement connectors; and a plurality of conductors mounted on the substrate, each of the conductors extending, defining a path, and establishing electrical connection between a contact wire mounting location and an insulation displacement connector mounting location. At least one of the conductors includes two self-coupling sections that are immediately adjacent to each other and that have identical instantaneous current direction such that the sections self-couple and cause a localized increase in inductance.

18 Claims, 5 Drawing Sheets

U.S. PATENT DOCUMENTS

| | | | |
|---|---|---|---|
| 5,547,405 | A | 8/1996 | Pinney et al. |
| 5,571,035 | A | 11/1996 | Ferrill |
| 5,587,884 | A | 12/1996 | Raman |
| 5,618,185 | A | 4/1997 | Aekins |
| 5,779,503 | A | 7/1998 | Tremblay et al. |
| 5,911,602 | A | 6/1999 | Vaden |
| 5,915,989 | A | 6/1999 | Adriaenssens et al. |
| 5,921,818 | A | 7/1999 | Larsen et al. |
| 5,947,772 | A | 9/1999 | Arnett et al. |
| 5,961,354 | A | 10/1999 | Hashim |
| 5,967,853 | A | 10/1999 | Hashim |
| 5,971,813 | A | 10/1999 | Kunz et al. |
| 5,975,919 | A | 11/1999 | Arnett et al. |
| 5,989,071 | A | 11/1999 | Larsen et al. |
| 5,997,358 | A | 12/1999 | Adriaenssens et al. |
| 6,017,247 | A | 1/2000 | Gwiazdowski |
| 6,042,427 | A | 3/2000 | Adriaenssens et al. |
| 6,050,843 | A | 4/2000 | Adriaenssens et al. |
| 6,102,730 | A | 8/2000 | Kjeidahl et al. |
| 6,116,964 | A | 9/2000 | Goodrich et al. |
| 6,120,330 | A | 9/2000 | Gwiazdowski |
| 6,165,023 | A | 12/2000 | Troutman et al. |
| 6,170,154 | B1 | 1/2001 | Swarup |
| 6,186,834 | B1 | 2/2001 | Arnett et al. |
| 6,196,880 | B1 | 3/2001 | Goodrich et al. |
| 6,238,235 | B1 | 5/2001 | Shavit et al. |
| 6,270,358 | B1 | 8/2001 | Nozick |
| 6,270,381 | B1 | 8/2001 | Adriaenssens |
| 6,312,290 | B1 | 11/2001 | Belopolsky |
| 6,350,158 | B1 | 2/2002 | Arnett et al. |
| 6,353,540 | B1 | 3/2002 | Narizuka et al. |
| 6,356,162 | B1 | 3/2002 | Deflandre et al. |
| 6,364,694 | B1 | 4/2002 | Lien |
| 6,379,157 | B1 | 4/2002 | Curry et al. |
| 6,379,198 | B1 | 4/2002 | Arnett et al. |
| 6,407,542 | B1 | 6/2002 | Conte |
| 6,428,362 | B1 | 8/2002 | Phommachanh |
| 6,443,776 | B2 | 9/2002 | Reichle |
| 6,443,777 | B1 | 9/2002 | McCurdy et al. |
| 6,464,529 | B1 | 10/2002 | Jensen et al. |
| 6,520,807 | B2 | 2/2003 | Winings |
| 6,524,128 | B2 | 2/2003 | Marowsky et al. |
| 6,530,810 | B2 | 3/2003 | Goodrich |
| 6,558,204 | B1 | 5/2003 | Weatherly |
| 6,558,207 | B1 | 5/2003 | Pepe et al. |
| 6,561,838 | B1 | 5/2003 | Blichfeldt |
| 6,592,395 | B2 | 7/2003 | Brown et al. |
| 6,764,348 | B2 | 7/2004 | Han et al. |
| 6,811,442 | B1 | 11/2004 | Lien et al. |
| 6,840,816 | B2 * | 1/2005 | Aekins ..... 439/676 |
| 6,962,503 | B2 | 11/2005 | Aekins |
| 2001/0018287 | A1 | 8/2001 | Reichle |
| 2001/0021608 | A1 | 9/2001 | Borbolla et al. |
| 2001/0048592 | A1 | 12/2001 | Nimomiya |
| 2002/0088977 | A1 | 7/2002 | Mori et al. |
| 2003/0129880 | A1 | 7/2003 | Arnett et al. |
| 2004/0002267 | A1 | 1/2004 | Hatterscheid et al. |
| 2006/0121788 | A1 | 6/2006 | Pharney |
| 2006/0121789 | A1 | 6/2006 | Hashim |
| 2006/0160428 | A1 | 7/2006 | Hashim |

FOREIGN PATENT DOCUMENTS

| | | |
|---|---|---|
| EP | 0 901 201 | 3/1999 |
| EP | 1 059 704 | 12/2000 |
| EP | 1 191 646 | 3/2002 |
| EP | 1 435 679 | 7/2004 |
| WO | WO 94/05092 | 3/1994 |
| WO | WO 99/53574 | 10/1999 |
| WO | WO 2003-019734 | 3/2003 |
| WO | WO 03/090322 | 10/2003 |

OTHER PUBLICATIONS

Belden CDT Networking Data Sheet for the 10GX Module www.BeldenIBDN.com.

International Search Report and Written Opinion of the International Searching Authority for PCT Application No. PCT/US2005/039586 mailed on Mar. 7, 2006.

Hashim et al. "Next High Frequency improvement by Using Frequency Dependent Effective Capacitance" U.S. Appl. No. 10/845,104, filed on May 14, 2004.

* cited by examiner

COMMUNICATIONS JACK WITH PRINTED WIRING BOARD HAVING SELF-COUPLING CONDUCTORS

RELATED APPLICATION

The present application claims priority from U.S. Provisional Patent Application Ser. No. 60/636,590, filed Dec. 16, 2004, entitled IMPROVING RETURN LOSS IN CONNECTORS BY CONDUCTOR SELF-COUPLING disclosure of which is hereby incorporated herein in its entirety.

FIELD OF THE INVENTION

The present invention relates generally to communication connectors and more particularly to the improvement of return loss in high frequency communication connectors.

BACKGROUND OF THE INVENTION

In an electrical communication system, it is sometimes advantageous to transmit information signals (video, audio, data) over a pair of wires (hereinafter "wire-pair" or "differential pair") rather than a single wire, wherein the transmitted signal comprises the voltage difference between the wires without regard to the absolute voltages present. Each wire in a wire-pair is susceptible to picking up electrical noise from sources such as lightning, automobile spark plugs and radio stations to name but a few. Because this type of noise is common to both wires within a pair, the differential signal is typically not disturbed. This is a fundamental reason for having closely spaced differential pairs.

Of greater concern, however, is the electrical noise that is picked up from nearby wires or pairs of wires that may extend in the same general direction for some distances and not cancel differentially on the victim pair. This is referred to as crosstalk. Particularly, in a communication system involving networked computers, channels are formed by cascading plugs, jacks and cable segments. In such channels, a modular plug often mates with a modular jack, and the routing of the electrical wires (conductors) within the jack and/or plug also can produce near-end crosstalk (NEXT) (i.e., the crosstalk measured at an input location corresponding to a source at the same location). This crosstalk occurs from closely-positioned wires over a short distance. In all of the above situations, undesirable signals are present on the electrical conductors that can interfere with the information signal. As long as the same noise signal is added to each wire in the wire-pair, the voltage difference between the wires will remain about the same and differential cross-talk does not exist.

U.S. Pat. No. 5,997,358 to Adriaenssens et al. (hereinafter "the '358 patent") describes a two-stage scheme for compensating differential to differential NEXT for a plug-jack combination (the entire contents of the '358 patent are hereby incorporated herein by reference, as are U.S. Pat. Nos. 5,915,989; 6,042,427; 6,050,843; and 6,270,381). Connectors described in the '358 patent can reduce the internal NEXT (original crosstalk) between the electrical wire pairs of a modular plug by adding a fabricated or artificial crosstalk, usually in the jack, at one or more stages, thereby canceling or reducing the overall crosstalk for the plug-jack combination. The fabricated crosstalk is referred to herein as a compensation crosstalk. This idea can often be implemented by twice crossing the path of one of the differential pairs within the connector relative to the path of another differential pair within the connector, thereby providing two stages of NEXT compensation. This scheme can be more efficient at reducing the NEXT than a scheme in which the compensation is added at a single stage, especially when the second and subsequent stages of compensation include a time delay that is selected to account for differences in phase between the offending and compensating crosstalk. This type of arrangement can include capacitive and/or inductive elements that introduce multi-stage crosstalk compensation, and is typically employed in jack lead frames and PWB structures within jacks. These configurations can allow connectors to meet "Category 6" performance standards set forth in ANSI/EIA/TIA 568, which are primary component standards for mated plugs and jacks for transmission frequencies up to 250 MHz.

Unfortunately, the introduction of compensatory crosstalk can negatively impact other electrical properties. For example, "return loss" measures the degree to which the input impedance of a plug-jack combination or an unshielded twisted wire pair (UTP) matches 100 ohms. Achieving acceptable return loss performance, particularly on conductor pairs 1 and 3 (as designated in TIA 568B) of an eight conductor jack, can be especially challenging due to the heavy crosstalk compensation typically required by these two pairs. Pair 1 return loss can be further aggravated by high capacitance shunting resulting from the close proximity of its two contact blades (i.e., its "tip" and "ring") in a plug. Reaching an acceptable compromise between crosstalk compensation and return loss can be exceptionally challenging for plugs that are to meet or exceed Category 6 performance parameters, particularly if data transmission speeds of 10 Gb/s over UTP are desired over a frequency range of 1-500 MHz.

SUMMARY OF THE INVENTION

The present invention can address some of the issues raised by prior art connectors. As a first aspect, embodiments of the present invention are directed to a wiring board for a communications jack. The wiring board comprises: a dielectric mounting substrate, the mounting substrate including a plurality of mounting locations for contact wires and a plurality of mounting locations for insulation displacement connectors; and a plurality of conductors mounted on the substrate, each of the conductors extending, defining a path, and establishing electrical connection between a contact wire mounting location and an insulation displacement connector mounting location. At least one of the conductors includes two self-coupling sections that are immediately adjacent to each other and that have identical instantaneous current direction such that the sections self-couple and cause a localized increase in inductance. The localized increase in inductance can, in turn, result in an increase in return loss for the communications jack.

As a second aspect, embodiments of the present invention are directed to a communications jack, comprising: a jack frame having a plug aperture; a plurality of contact wires, the contact wires having free ends that extend into the plug aperture, the free ends of the contact wires being arranged serially in side-by-side relationship; a plurality of insulation displacement connectors; a dielectric mounting substrate, the mounting substrate including a plurality of mounting locations for contact wires and a plurality of mounting locations for insulation displacement connectors; and a plurality of conductors mounted on the substrate, each of the conductors extending, defining a path, and establishing electrical connection between a contact wire mounting location and an insulation displacement connector mounting location. At least one of the conductors includes two self-coupling sections that are immediately adjacent to each other and that have identical instantaneous current direction such that the sections self-couple and cause a localized increase in inductance.

As a third aspect, embodiments of the present invention are directed to a communications connector comprising: a mounting substrate; a plurality of conductors mounted on the mounting substrate; a plurality of connectors, each electrically connected to a respective one of the plurality of conductors; and a plurality of contacts, each electrically connected to a respective one of the plurality of conductors. At least one of the plurality of conductors is configured such that it includes two self-coupling sections that are immediately adjacent to each other and that have identical instantaneous current direction such that the sections self-couple and cause a localized increase in inductance.

As a fourth aspect, embodiments of the present invention are directed to a method of increasing return loss in a communications connector, the connector comprising a wiring board and a plurality of conductors mounted thereon. The method comprises the step of self-coupling sections of a conductor that are immediately adjacent to each other and that have identical instantaneous current direction such that the sections self-couple and cause a localized increase in inductance.

As a fifth aspect, embodiments of the present invention are directed to a method of increasing localized inductance in a conductor of a communications connector, the connector comprising a wiring board and a plurality of conductors mounted thereon, the method comprising the step of self-coupling sections of the conductor that are immediately adjacent to each other and that have identical instantaneous current direction such that the sections self-couple and cause a localized increase in inductance.

DETAILED DESCRIPTION OF EMBODIMENTS OF THE INVENTION

Figure 1:
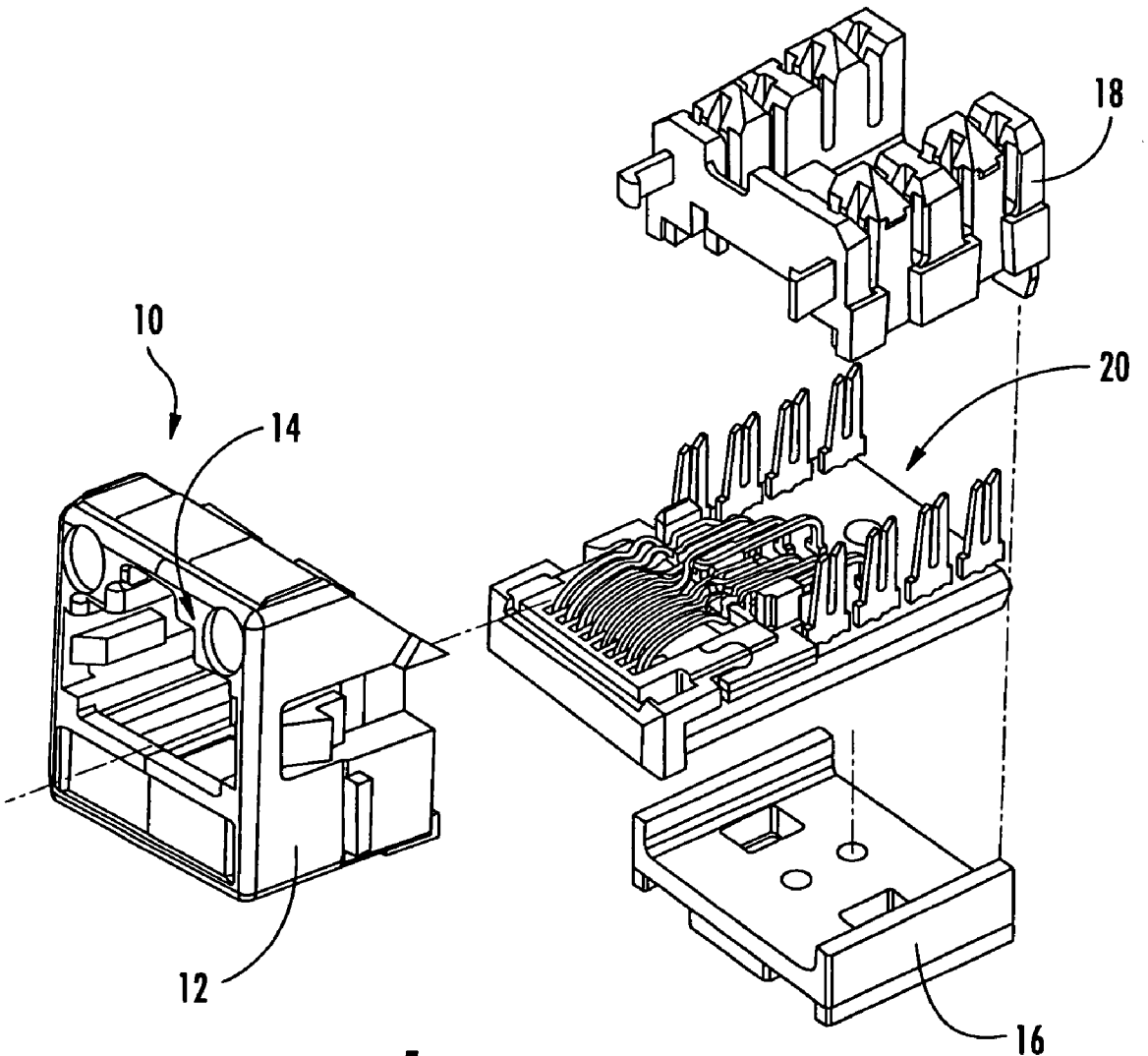
FIG. 1 (PRIOR ART)
FIG. 1 is an exploded perspective view of a communications jack according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. As used herein, the term "and/or" includes any and all combinations of one or more of the associated listed items. Where used, the terms "attached", "connected", "interconnected", "contacting", "mounted" and the like can mean either direct or indirect attachment or contact between elements, unless stated otherwise. Also, where used, the terms "coupled", "induced" and the like can mean nonconductive electrical interaction, either direct or indirect, between elements or different sections of the same element, unless otherwise stated. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Referring now to the figures, an exemplary communications jack, designated broadly at 10, is illustrated in FIG. 1. The illustrated jack 10 is of the configuration known in this art as an RJ11- or RJ45-style jack. The jack 10 includes a jack frame 12 having a plug aperture 14 for receiving a mating plug (not shown—exemplary plugs are illustrated in U.S. Pat. No. 6,250,949 to Lin and in co-pending and co-assigned U.S. Provisional Patent Application Ser. No. 60/633,783, filed Dec. 7, 2004 and entitled COMMUNICATION PLUG WITH BALANCED WIRING TO REDUCE DIFFERENTIAL TO COMMON MODE CROSSTALK, a cover 16 and a terminal housing 18. These components are conventionally formed and not need be described in detail herein; for a further description of these components and the manner in which they interconnect, see U.S. Pat. No. 6,350,158 to Arnett et al., the disclosure of which is hereby incorporated herein in its entirety. Those skilled in this art will recognize that other configurations of jack frames, covers and terminal housings may also be employed with the present invention. Exemplary configurations are illustrated in U.S. Pat. Nos. 5,975,919 and 5,947,772 to Arnett et al. and U.S. Pat. No. 6,454,541 to Hashim et al., the disclosure of each of which is hereby incorporated herein in its entirety.

Figure 1A:
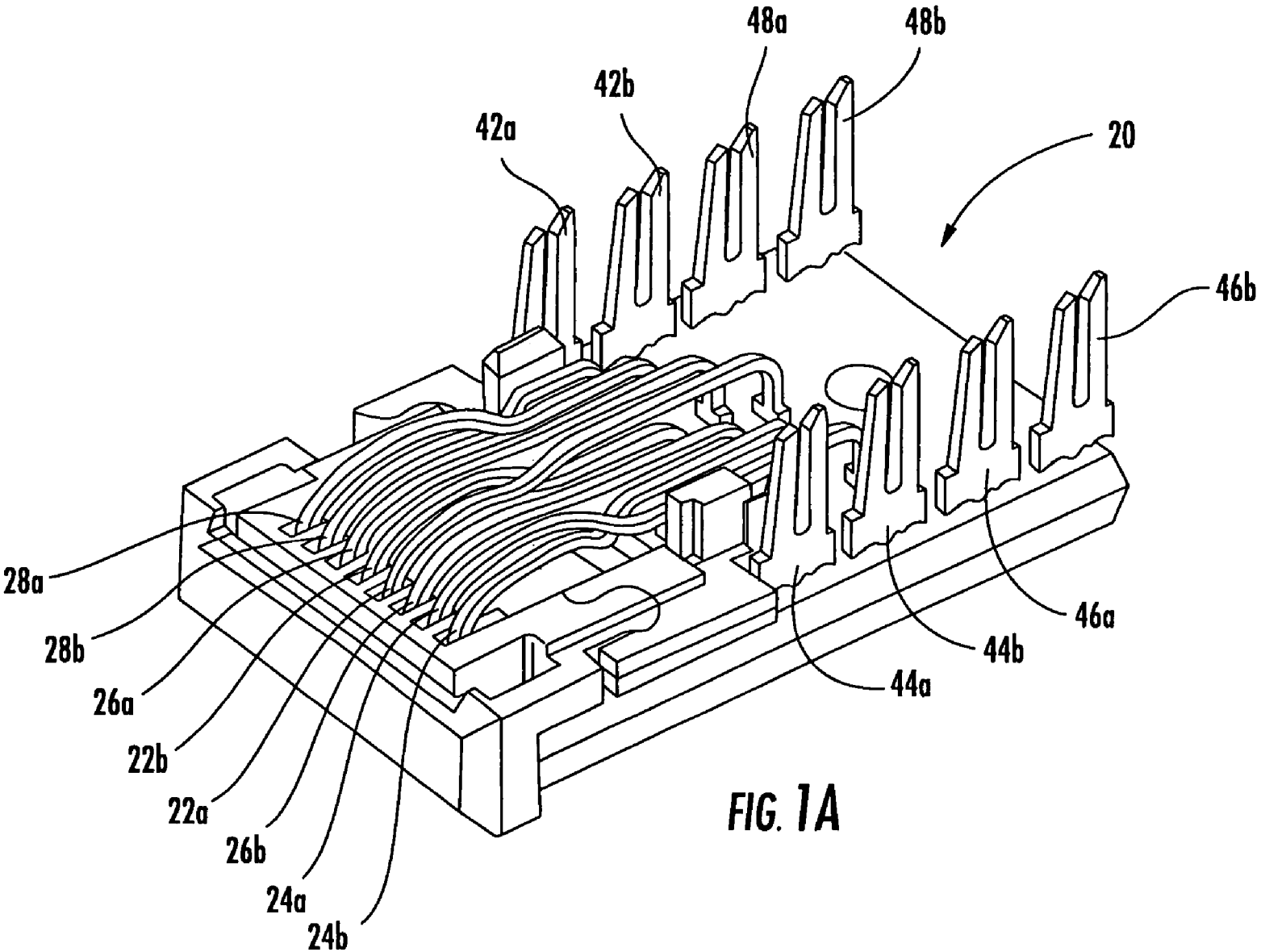
FIG. 1A is an enlarged perspective view of a wiring board of the communications jack of FIG. 1.
Figure 2:
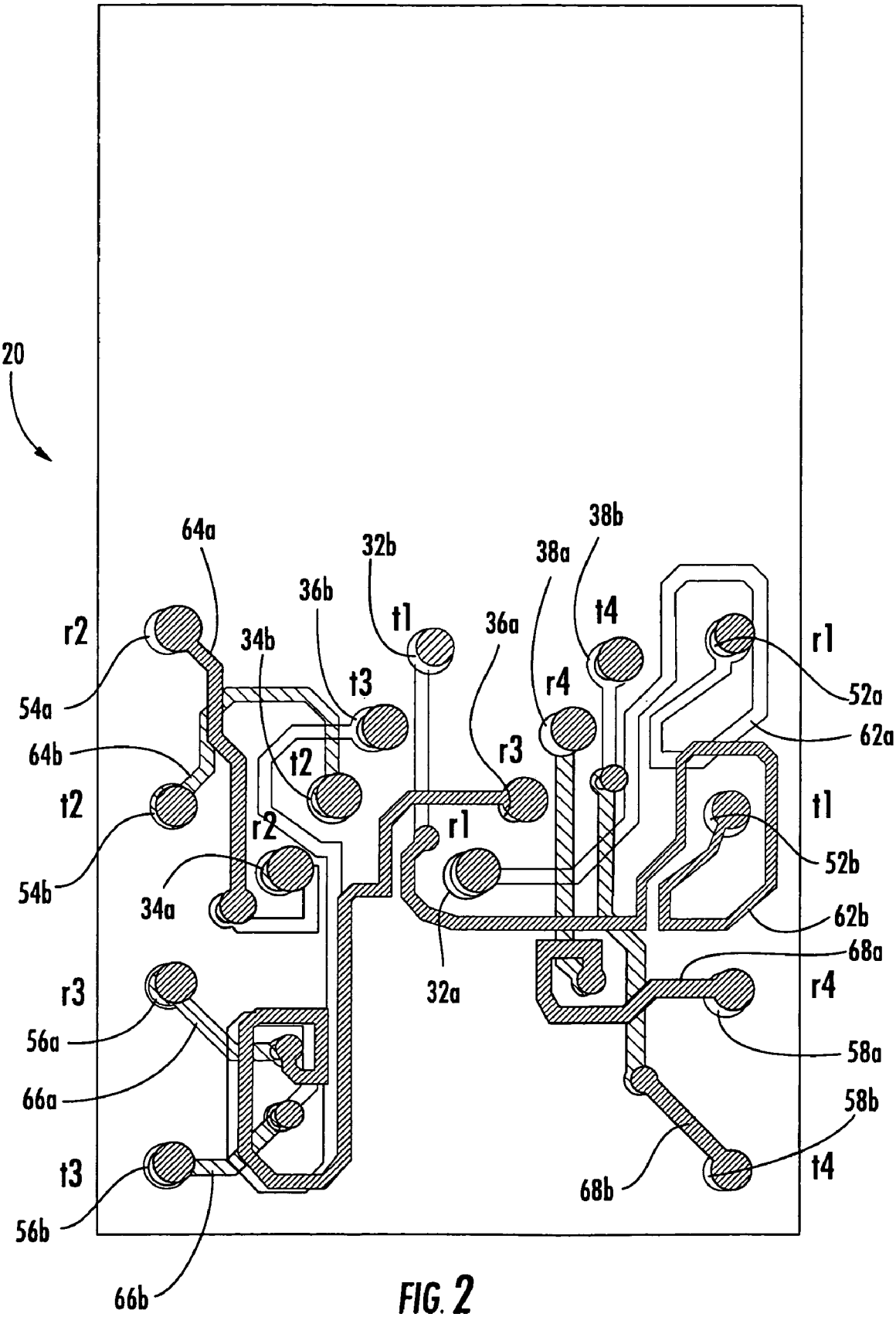
FIG. 2 is a schematic plan view of a wiring board of the jack of FIG. 1, with conductors residing on different layers of the wiring board being shown in different shading and/or cross-hatching.

Referring still to FIG. 1 and also to FIGS. 1A and 2, the jack 10 further includes a wiring board 20 formed of conventional materials. The wiring board 20 may be a single layer board or, as illustrated, may have multiple layers. The wiring board 20 may be substantially planar as illustrated, or may be non-planar.

Contact wires 22*a*, 22*b*, 24*a*, 24*b*, 26*a*, 26*b*, 28*a*, 28*b* are attached to the wiring board 20. As described in U.S. Pat. No. 6,350,158 referenced above, the contact wires 22*a*, 22*b*, 24*a*, 24*b*, 26*a*, 26*b*, 28*a*, 28*b* have free ends that are disposed generally parallel to each other and that extend into the plug aperture 14 of jack frame 12 to form electrical contact with the terminal blades of a mating plug. The contact wires 22*a*, 22*b*, 24*a*, 24*b*, 26*a*, 26*b*, 28*a*, 28*b* are arranged in pairs defined by TIA 568B, with wires 22*a*, 22*b* (pair 1) being adjacent to each other and in the center of the sequence of wires, wires 24*a*, 24*b* (pair 2) being adjacent to each other and occupying the leftmost two positions (from the vantage point looking from the rear of the jack 10 toward a mating plug in the plug aperture 14) in the sequence, wires 28*a*, 28*b* (pair 4) being adjacent to each other and occupying the rightmost two positions (again, from the same vantage point as just discussed above) in the sequence, and wires 26*a*, 26*b* (pair 3) being positioned between, respectively, pairs 1 and 4 and pairs 1 and 2. The wires 22*a*, 22*b*, 24*a*, 24*b*, 26*a*, 26*b*, 28*a*, 28*b* are mounted to the wiring board 20 via insertion into respective apertures 32*a*, 32*b*, 34*a*, 34*b*, 36*a*, 36*b*, 38*a*, 38*b*, which are arranged in the illustrated embodiment in a "dual diagonal" pattern as described in U.S. Pat. No. 6,196,880 to Goodrich et al., the disclosure of which is hereby incorporated herein in its entirety.

Those skilled in this art will appreciate that contact wires or other contacts of other configurations may be used. As one example, contact wires configured as described in aforementioned U.S. Pat. No. 5,975,919 to Arnett et al. may be employed. As another example, contact wires as configured in U.S. Provisional Patent Application Ser. No. 60/636,595, filed Dec. 16, 2004 and entitled CROSSOVER FOR SIMULTANEOUSLY COMPENSATING DIFFERENTIAL TO DIFFERENTIAL OR DIFFERENTIAL TO COMMON MODE CROSSTALK may be employed. The skilled artisan will recognize other suitable alternative configurations.

Eight insulation displacement connectors (IDCs) 42*a*, 42*b*, 44*a*, 44*b*, 46*a*, 46*b*, 48*a*, 48*b* are inserted into eight respective IDC apertures 52*a*, 52*b*, 54*a*, 54*b*, 56*a*, 56*b*, 58*a*, 58*b*. The IDCs may be of conventional construction and need not be described in detail herein; exemplary IDCs are illustrated and described in aforementioned U.S. Pat. No. 5,975,919 to Arnett. Connectors other than IDCs may also be employed.

Referring now to FIG. 2, the each of the wire apertures 32*a*, 32*b*, 34*a*, 34*b*, 36*a*, 36*b*, 38*a*, 38*b* is electrically connected to a respective IDC aperture 52*a*, 52*b*, 54*a*, 54*b*, 56*a*, 56*b*, 58*a*, 58*b* via a respective conductor 62*a*, 62*b*, 64*a*, 64*b*, 66*a*, 66*b*, 68*a*, 68*b*, thereby interconnecting each of the contact wires 22*a*, 22*b*, 24*a*, 24*b*, 26*a*, 26*b*, 28*a*, 28*b* to its corresponding IDC 42*a*, 42*b*, 44*a*, 44*b*, 46*a*, 46*b*, 48*a*, 48*b*. The conductors 62*a*, 62*b*, 64*a*, 64*b*, 66*a*, 66*b*, 68*a*, 68*b* are formed of conventional conductive materials and are deposited on the wiring board 20 via any deposition method known to those skilled in this art to be suitable for the application of conductors. Some conductors are illustrated as being entirely present on a single layer of the wiring board 20 (for example, conductor 62*a*), while other conductors (for example, conductor 62*b*) may reside on multiple layers of the wiring board 20; conductors can travel between layers through the inclusion of vias (also known as plated through holes) or other layer-transferring structures known to those skilled in this art.

Figure 3:
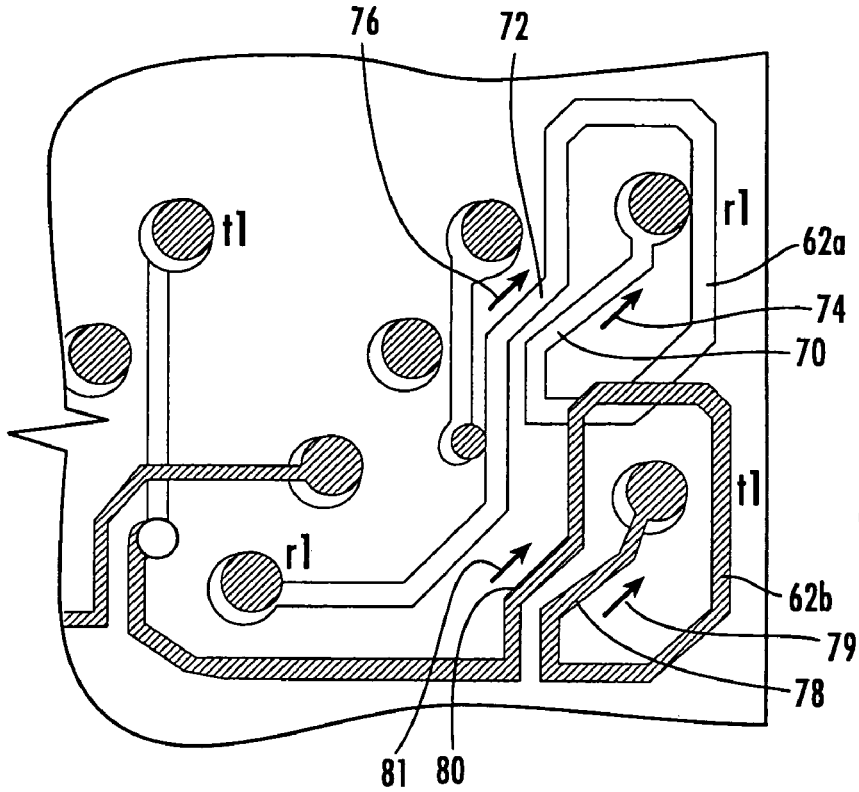
FIG. 3 is an enlarged plan view of a conductor pair of the wiring board of FIG. 2.

Referring now to FIG. 3, it can be seen that conductor 62*a*, which connects contact wire 22*a* to IDC 42*a* (i.e., it connects the "ring" of pair 1) includes sections 70, 72 that are immediately adjacent each other and that, in this embodiment, follow substantially parallel paths. It can also be seen via the arrows 74, 76 that the polarity of the segments is identical, i.e., that the instantaneous current direction (and, thus signal direction) in the segments is the same. The immediate adjacency of this arrangement causes self-coupling between the sections 70, 72 of the conductor 62*a*, which in turn triggers an increase in localized inductance. Similarly, conductor 62*b*, which connects contact wire 22*b* to IDC 42*b* (thereby connecting the "tip" of pair 1) includes sections 78, 80 that are immediately adjacent each other and that follow substantially parallel paths with identical instantaneous current direction (see arrows 79, 81). These sections also self-couple and experience an increase in localized inductance.

It has been determined that judicious selection of portions of a conductor that are immediately adjacent each other with identical instantaneous current direction can control the input impedance of a mated plug-jack combination, and, consequently, can control return loss. As such, the jack 10 can withstand the increased crosstalk compensation that may be necessary to achieve, in a mated plug-jack combination, elevated frequency signal transmission while still experiencing acceptable levels of return loss. Typically, conductors of pair 1 that are immediately adjacent to each other for a distance of between about 0.05 and 0.2 inches may be employed, although this distance may vary. The gap between the immediately adjacent segments may be between about 5 to 20 mils; in some embodiments, a minimum gap between adjacent conductors of at least 8 mils is preferred. In a typical jack, causing an increase of between about 2 to 8 nanohenries in localized inductance in pair 1 can provide the desired improvement in return loss (the expected level of inductance can be calculated using, for example, equations set forth in H. Greenhouse, *Design of Planar Rectangular Microelectric Inductors*, IEEE Transactions on Parts, Hybrids, and Packaging, Vol. PHP-10, No. 2 (June 1974) at page 103).

Figure 4:
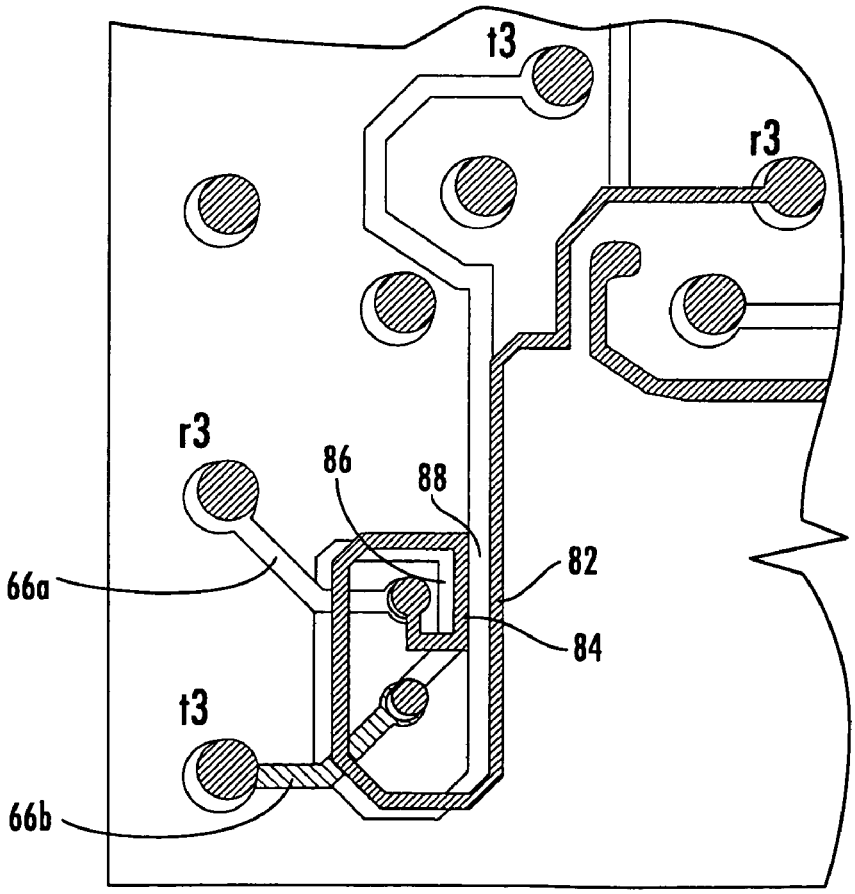
FIG. 4 is an enlarged plan view of a second conductor pair of the wiring board of FIG. 2.

Referring now to FIG. 4, a similar arrangement is illustrated for the conductors 66*a*, 66*b* of pair 3. Conductor 66*a* includes sections 82, 84 that are immediately adjacent and substantially parallel with each other with identical signal polarity, and conductor 66*b* includes sections 86, 88 that are immediately adjacent and substantially parallel with each other with identical signal polarity. These sections also self-couple and induce localized increases in inductance that can help to control the input impedance of a mated jack-plug combination. Typically, conductors of pair 3 that are immediately adjacent to each other for a distance of between about 0.05 and 0.20 inches may be employed, although this distance may vary. The gap between the immediately adjacent segments may be as described above for pair 1. In a typical jack, causing an increase of between about 2 to 8 nanohenries in localized inductance in pair 3 can provide the desired improvement in return loss.

Typically, and as illustrated, the inclusion of self-coupling sections in conductors of pairs 1 and 3 is sufficient for improving the return loss performance of those pairs; however, this concept can be applied to either of these pairs of conductors alone, and/or to either or both of pairs 2 and 4, or to other conductors of jacks that employ different numbers of conductors (e.g., a sixteen conductor jack). Also, although in the illustrated embodiment both of the self-coupling conductors of a wire pair are mounted on the same layer of the wire board, this need not be the case; one or more layers of a wire board may separate the self coupling sections of the conductors. Moreover, the skilled artisan will recognize that many different conductor paths that utilize the concepts of the present invention may be employed.

Those skilled in this art will recognize that embodiments of the wiring board described above may be employed in other environments in which a communications jack may be found. For example, jacks within a patch panel or series of patch panels may be suitable for use with such wiring boards. Other environments may also be possible.

Those skilled in this art will further recognize that the conductor self-coupling sections described above can be implemented, with similar beneficial effect on return loss, by forming the conductor leads of jacks utilizing metallic lead-frame structures instead of printed wiring boards to achieve the required connectivity and crosstalk compensation. In such a configuration, the contact wires and/or the insulation displacement connectors may be formed integrally with the conductors as unitary members.

The invention will now be described in greater detail in the following non-limiting example.

EXAMPLE

Communications jacks of the configuration illustrated in FIG. 1 were constructed. In one set of jacks, the wiring board included conductors of pair 3 that substantially match that illustrated in FIG. 4. In a second set of jacks, the wiring board included conductors that did not have the self-coupling sections. The jacks were then tested for return loss on pair 3 under the conditions set forth in TIA/EIA-568-B.2-1 Annex E.

Figure 5:
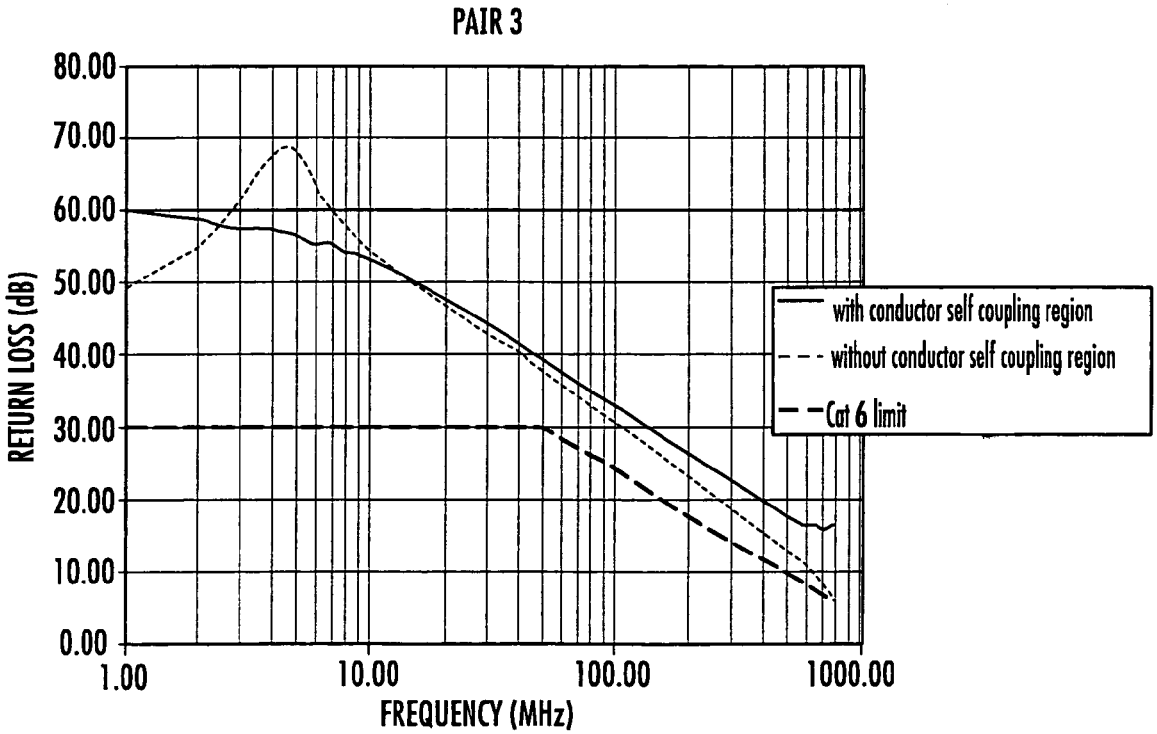
FIG. 5 is a graph plotting return loss as a function of frequency for conventional and experimental jacks.

Results of the testing are shown in FIG. 5. It can be seen that the experimental jack employing self-coupling conductors exhibited in increase in the return loss decibel level (i.e., an improvement) over the conventional jack, at frequencies above about 15 MHz. Furthermore, unlike the conventional jack, the experimental jack did not exhibit deterioration with frequency of its return loss margin relative to the TIA category 6 limit.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

The invention claimed is:

1. A communications connector, comprising:

a plurality of input terminals;

a plurality of output terminals; and a plurality of conductive paths that connect respective ones of the plurality of input terminals to respective ones of the plurality of output terminals;

wherein at least one of the conductive paths includes two self-coupling sections that are immediately adjacent to each other and that have generally the same instantaneous current direction such that the sections self-couple and cause a localized increase in inductance.

2. The connector defined in claim 1, wherein the two self-coupling sections are adjacent one of the plurality of output terminals.

3. The connector defined in claim 1, wherein the self-coupling sections travel immediately adjacent to each other for about 0.05 to about 0.20 inches.

4. The connector defined in claim 1, wherein a gap between the self-coupling sections is between about 8 and about 15 mils.

5. The connector defined in claim 1, wherein the self-coupling sections cause a localized increase in inductance of between about 2 and about 8 nanohenries.

6. The connector defined in claim 1, wherein the connector comprises a communications jack, wherein each of the plurality of conductive paths are partially implemented on a wiring board, and wherein the two self-coupling sections comprise traces on the wiring board.

7. The connector defined in claim 1, wherein the self-coupling sections are substantially parallel to each other.

8. The connector defined in claim 1, wherein the plurality of conductive paths are configured as differential pairs so that the at least one of the conductive paths is part of one of the differential pairs.

9. The connector defined in claim 8, wherein the localized increase in inductance is selected to provide an input impedance of approximately 100 ohms on the one of the differential pairs that includes the at least one of the conductive paths that includes two self-coupling sections.

10. The connector defined in claim 8, wherein an amount of the localized increase in inductance is selected based at least in part on the amount of improvement the localized increase in inductance provides in the return loss associated with the one of the differential pairs that includes the at least one of the conductive paths that includes two self-coupling sections.

11. The connector defined in claim 10, wherein the self-coupling sections provide at least about 3 dB improvement in return loss above 100 MHz.

12. The connector defined in claim 1, wherein the plurality of conductive paths are configured as differential pairs, wherein the at least one of the conductive paths is a first conductive path of a first of the differential pairs, and wherein a second of the plurality of conductive paths that is a second conductive path of the first of the differential pairs also includes two self-coupling sections that are immediately adjacent to each other and that have generally the same instantaneous current direction such that the sections self-couple and cause a localized increase in inductance.

13. The connector defined in claim 12, wherein at least one of the conductive paths of a second of the differential pairs includes self-coupling sections that are immediately adjacent to each other and that have substantially the same instantaneous current direction such that the sections self-couple and cause a localized increase in inductance.

14. The connector defined in claim 13, wherein the conductive paths of the first of the differential pairs are electrically connected to respective first and second of the plurality of contacts that have free ends that are adjacent to each other, and wherein the conductive paths of the second of the differential pairs are electrically connected to respective third and fourth of the plurality of contacts that have free ends that sandwich the free ends of the first and second of the plurality of contacts.

15. The connector defined in claim 1, the connector further comprising a wiring board, wherein the plurality of input terminals comprise a plurality of contact wires, wherein the plurality of output terminals comprise a plurality of insulation displacement contacts, wherein the wiring board includes a dielectric mounting substrate that has a plurality of mounting locations for respective ones of the plurality of contact wires and a plurality of mounting locations for respective ones of the plurality of insulation displacement contacts, and wherein the plurality of conductive paths comprise a plurality of respective traces on the wiring board that electrically connect a respective one of the plurality of contact wire mounting locations to a respective one of the plurality of insulation displacement contact mounting locations.

16. The connector defined in claim 15, wherein the contact wire mounting locations define two generally parallel lines.

17. The connector defined in claim 15, further comprising a housing having a plug aperture, wherein the plurality of contacts are configured to mate with respective of a plurality of plug contacts when a plug is inserted in the plug aperture.

18. The connector defined in claim 15, wherein the two self-coupling sections are adjacent one of the plurality of insulation displacement contact mounting locations.

* * * * *